US011192009B1

(12) United States Patent
Saphire

(10) Patent No.: US 11,192,009 B1
(45) Date of Patent: Dec. 7, 2021

(54) RETRACTABLE AND DETACHABLY ENGAGEABLE SPORTS NET SYSTEM

(71) Applicant: Saphire Hospitality, Inc., San Diego, CA (US)

(72) Inventor: Jason Saphire, San Diego, CA (US)

(73) Assignee: Saphire Hospitality, Inc., San Diego, CA (US)

( * ) Notice: Subject to any disclaimer, the term of this patent is extended or adjusted under 35 U.S.C. 154(b) by 0 days.

(21) Appl. No.: 17/188,804

(22) Filed: Mar. 1, 2021

Related U.S. Application Data

(63) Continuation-in-part of application No. 29/745,311, filed on Aug. 5, 2020.

(60) Provisional application No. 63/076,218, filed on Sep. 9, 2020, provisional application No. 63/061,331, filed on Aug. 5, 2020.

(51) Int. Cl.
*A63B 61/00* (2006.01)

(52) U.S. Cl.
CPC ..... *A63B 61/003* (2013.01)

(58) Field of Classification Search
CPC ..... E01F 13/028; A63B 61/003; A63B 61/02; A63B 61/00; A63B 67/045; A63B 2102/04
USPC ..... 473/494; 256/24, 26, 45, 47, 52, 54, 58
See application file for complete search history.

(56) References Cited

U.S. PATENT DOCUMENTS

| | | | | |
|---|---|---|---|---|
| 2,497,925 A | | 2/1950 | Bergerioux | |
| 2,615,715 A | | 10/1952 | Ballard | |
| 3,452,985 A | * | 7/1969 | Zmura | A63B 67/04 473/475 |
| 4,014,521 A | | 3/1977 | Berman | |
| 4,108,434 A | | 8/1978 | Royer | |
| 4,235,455 A | | 11/1980 | Collins et al. | |
| 4,335,877 A | | 6/1982 | Long | |
| 4,436,304 A | | 3/1984 | Castleman et al. | |
| 4,474,339 A | | 10/1984 | Sato | |
| 4,522,395 A | | 6/1985 | Arndt | |
| 4,993,719 A | * | 2/1991 | Hernandez | A63B 61/02 273/298 |

(Continued)

FOREIGN PATENT DOCUMENTS

| | | | |
|---|---|---|---|
| CN | 209475502 | U | 10/2019 |
| KR | 20110101432 | A | 9/2011 |
| WO | 2019180399 | A1 | 3/2019 |

OTHER PUBLICATIONS

Gopher Sport, 4-Way Accessory Net, webpage <https://www.gophersport.com/sports/volleyball/4-way-accessory-net>, 3 pages, retrieved Aug. 10, 2020.

(Continued)

*Primary Examiner* — John E Simms, Jr.
*Assistant Examiner* — Rayshun K Peng
(74) *Attorney, Agent, or Firm* — Stetina, Brunda, Garred and Brucker

(57) ABSTRACT

A net system comprising a first net module including a first housing, a first net and a first connector connected to the first net. The first net being retractably connected to the first housing. The net system additionally includes a second net module including a second housing, a second net and a second connecter connected to the second net, the second net being retractably connected to the second housing. The first connector is connectable to the second connector to detachably connect the first net module to the second net module.

18 Claims, 10 Drawing Sheets

(56) References Cited

U.S. PATENT DOCUMENTS

| | | | | |
|---|---|---|---|---|
| 5,139,256 | A * | 8/1992 | Logan | A63B 61/003 256/11 |
| 5,674,139 | A | 10/1997 | Brooks | |
| 5,692,978 | A | 12/1997 | Hummel | |
| 5,827,137 | A | 10/1998 | Ishino | |
| 6,287,220 | B1 | 9/2001 | Caruso | |
| 6,575,435 | B1 | 6/2003 | Kotzen | |
| 6,904,872 | B2 | 6/2005 | Muller | |
| 7,311,617 | B2 | 12/2007 | Langhorn | |
| 7,367,907 | B1 | 5/2008 | Sutton et al. | |
| 7,608,000 | B2 | 10/2009 | Butler | |
| 7,637,827 | B2 | 12/2009 | Bangerter | |
| 7,727,091 | B2 | 6/2010 | Allen | |
| 8,430,772 | B1 | 4/2013 | Jones | |
| 9,504,892 | B2 | 11/2016 | Saphire | |
| 9,598,896 | B1 * | 3/2017 | Pichik | E06B 9/13 |
| 10,011,985 | B2 * | 7/2018 | Strong | E04B 2/76 |
| 2002/0005512 | A1 * | 1/2002 | Trill | E04H 17/168 256/25 |
| 2003/0144090 | A1 | 7/2003 | Belik | |
| 2004/0005941 | A1 | 1/2004 | Chen | |
| 2005/0098770 | A1 * | 5/2005 | Schell | E01F 13/028 256/25 |
| 2006/0116226 | A1 | 6/2006 | Padilla | |
| 2007/0138453 | A1 | 6/2007 | Le | |
| 2007/0191132 | A1 | 8/2007 | Bangerter | |
| 2007/0228349 | A1 | 10/2007 | Smith | |
| 2007/0298914 | A1 | 12/2007 | Allen | |
| 2009/0293411 | A1 | 12/2009 | Benner et al. | |
| 2013/0005515 | A1 * | 1/2013 | Saphire | A63B 67/002 473/492 |
| 2014/0179466 | A1 | 6/2014 | Myers | |
| 2018/0015343 | A1 * | 1/2018 | Orenstein | A63B 69/0017 |

OTHER PUBLICATIONS

Franklin, Quad Volleyball, webpage <https://franklinsports.com/quad-volleyball>, 2 pages, retrieved May 24, 2021.

Trainingnets By Powernet, PowerNet Volleyball Foursquare Net, webpage <https://www.trainingnets.com/products/powernet-volleyball-four-square-net>, 4 pages, retrieved May 24, 2021.

Sportime International, Fourcourt Volley How The Game is Played, 2 pages, 1998.

* cited by examiner

RETRACTABLE AND DETACHABLY ENGAGEABLE SPORTS NET SYSTEM

CROSS-REFERENCE TO RELATED APPLICATIONS

This application is a continuation-in-part of U.S. Design Application No. 29/745,311, filed Aug. 5, 2020 and additionally claims the benefit of U.S. Provisional Application No. 63/061,331, filed Aug. 5, 2020, and U.S. Provisional Application No. 63/076,218, filed Sep. 9, 2020, the contents of both of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to a net system, and more specifically, to a net system comprising a plurality of detachably connectable net modules having net segments retractable into respective housings.

2. Description of the Related Art

Games involving balls or other projectiles are very common. In many games, the ball or projectile is played on a court or playing surface having a net or barrier over which the projectile is propelled. Exemplary games may include volleyball, tennis, table tennis, badminton, or the like, wherein a ball, shuttlecock, or other projectile is launched/volleyed over the nets. Such games provide enjoyment to individuals of all ages.

In most of the above-mentioned games, the net is erected to divide the playing surface into two areas which are "defended" by opposing teams. The net is generally supported by two support poles which are secured to the ground in spaced relation to each other. Along these lines, many public locations, such as beaches, parks, schools, etc. include dedicated areas for playing such games, wherein support poles are permanently secured to the ground. For instance, it is common for a beach to include volleyball poles properly positioned to allow a user to attach his net thereto for playing beach volleyball. Likewise, public tennis courts commonly include support poles and a tennis net connected to the support poles in an erected position for users to enjoy.

In addition to the foregoing net/barrier games, another common pastime is the game of Four Square, which is typically played on a playing surface without a barrier. The game is commonly played with a resilient/bouncy ball on a solid ground surface, such as concrete or asphalt. Boundaries for the playing surface are marked on the ground to define a large square that is equally divided into four smaller squares. To begin play, players typically enter the large square and each individual player stands in one of the four interior play areas. The ball is served to begin a rally by hitting the ball by hand into any one of the other boxes. More specifically, once the ball is served, the ball enters one of the other internal play zones. The ball is allowed to bounce once, and then the player in that box must strike the ball such that it may bounce within another interior box before the ball bounces again. The rally continues by players striking and returning the ball to other internal play boxes until a player is unable to successfully return the ball to bounce within another player's box.

One of the deficiencies of conventional net/barrier games is that the associated net/barrier apparatus may be difficult to assemble and then subsequently take down and store. Accordingly, various aspects of the present disclosure address this particular need, as will be discussed in more detail below.

BRIEF SUMMARY

In accordance with one embodiment of the present disclosure, there is provided a net system comprising a first net module including a first spool, a first net, and a first connector connected to the first net, with the first net being retractably connected to the first spool such that the first net defines an extended length as a distance between the first spool and the first connector. The first net is transitional relative to the first spool between an extended position and a retracted position, with the extended length increasing as the first net transitions from the retracted position toward the extended position. The net system additionally includes a second net module including a second spool, a second net, and a second connecter connected to the second net, with the second net being retractably connected to the second spool such that the second net defines an extended length as a distance between the second spool and the second connector. The second net is transitional relative to the second spool between an extended position and a retracted position, with the extended length increasing as the second net transitions from the retracted position toward the extended position. The first connector is connectable to the second connector to detachably connect the first net module to the second net module.

The first net connector may include a wall disposed about a central axis, with the wall having an outer surface, an inner surface defining a center chamber, and a plurality of connector openings. Each connector opening may extend from the outer surface toward the inner surface. The plurality of connector openings may include an array of second connector openings and an array of third connector openings separate from the array of second connector openings. The array of second connector openings may be circumferentially spaced from the array of third connector openings by at least ninety degrees.

The first connector may include an opening and the second connector may include a hook selectively insertable within the opening to connect the second connector to the first connector.

The net system may additionally include a first pole connectable to the first spool and a second pole connectable to the second spool.

The net system may further comprise a first housing connected to the first spool, with the first housing defining a cavity sized to receive a retracted portion of the first net gathered around the first spool. A second housing may be connected to the second spool, with the second housing defining a cavity sized to receive a retracted portion of the second net gathered around the second spool.

The first housing may include a slot formed therein, with the slot being sized to allow for passage of the first net therethrough. The second housing may also include a slot formed therein, with the slot being sized to allow for passage of the second net therethrough.

The first spool may be rotatable in a first direction to facilitate transition of the first net from the extended position toward the retracted position and a second direction to facilitate transition of the first net from the retracted position toward the extended position. The net system may also include a first spring coupled to the first spool to bias the first spool to rotate in the first direction.

The net system may additionally include a first locking mechanism operatively engageable with the first spool and selectively transitional between a locked configuration and an unlocked configuration. The first locking mechanism may be configured to prevent rotation of the first spool in the first direction when the first locking mechanism is in the locked configuration. The first spool may be unhindered by the first locking mechanism when the first locking mechanism is in the unlocked configuration.

The first and second connectors may include complementary hooks and loops fasteners.

The net system may also include a third net module including a third spool, a third net, and a third connector connected to the third net. The third net may be retractably connected to the third spool such that the third net defines an extended length as a distance between the third spool and the third connector. The third net may be transitional relative to the third spool between an extended position and a retracted position, with the extended length increasing as the third net transitions from the retracted position toward the extended position. The third connector may be configured to be detachably engageable to one of the first and second connectors.

The net system may also include a fourth net module including a fourth spool, a fourth net, and a fourth connector connected to the fourth net. The fourth net may be retractably connected to the fourth spool such that the fourth net defines an extended length as a distance between the fourth spool and the fourth connector. The fourth net may be transitional relative to the fourth spool between an extended position and a retracted position, with the extended length increasing as the fourth net transitions from the retracted position toward the extended position. The fourth connector may be configured to be detachably engageable to one of the first and second connectors in spaced relation to the third connector.

The first net and the second net may extend outward relative to a central axis when the first connector is connected to the second connector. The first net module and the second net module may be configured to be supported above a ground surface independent of a support at the central axis.

According to another embodiment, there is provided an add-on net system configured for use with an existing net. The add-on net system includes a hub configured to be placeable on the existing net, and a first net module including a first spool, a first net, and a first connector connected to the first net. The first connector is detachably engageable with the hub, and the first net is retractably connected to the first spool such that the first net defines an extended length as a distance between the first spool and the first connector. The first net is transitional relative to the first spool between an extended position and a retracted position, with the extended length increasing as the first net transitions from the retracted position toward the extended position. The add-on net system additionally includes a second net module including a second spool, a second net, and a second connecter connected to the second net. The second connector is detachably engageable with the hub. The second net is retractably connected to the second spool such that the second net defines an extended length as a distance between the second spool and the second connector, with the second net being transitional relative to the second spool between an extended position and a retracted position. The extended length increases as the second net transitions from the retracted position toward the extended position.

The hub may include a first face, an opposing second face, and a slot extending into the hub from the first face toward the second face, with the slot being sized to accommodate passage of the existing net.

The hub may include a pair grooves formed therein in opposed relation to each other. The pair of grooves may be configured to receive respective ones of the first connector and the second connector. The hub may include a pair of opposed end faces, and the pair of grooves may each extend from one of the pair of opposed end faces toward the other of the pair of opposed end faces. Each of the pair of grooves may terminate in spaced relation to the pair of opposed end faces to define a shoulder.

The hub may additionally include a slot formed therein, with the slot extending diametrically through the hub such that the pair of grooves are on opposite sides of the slot.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
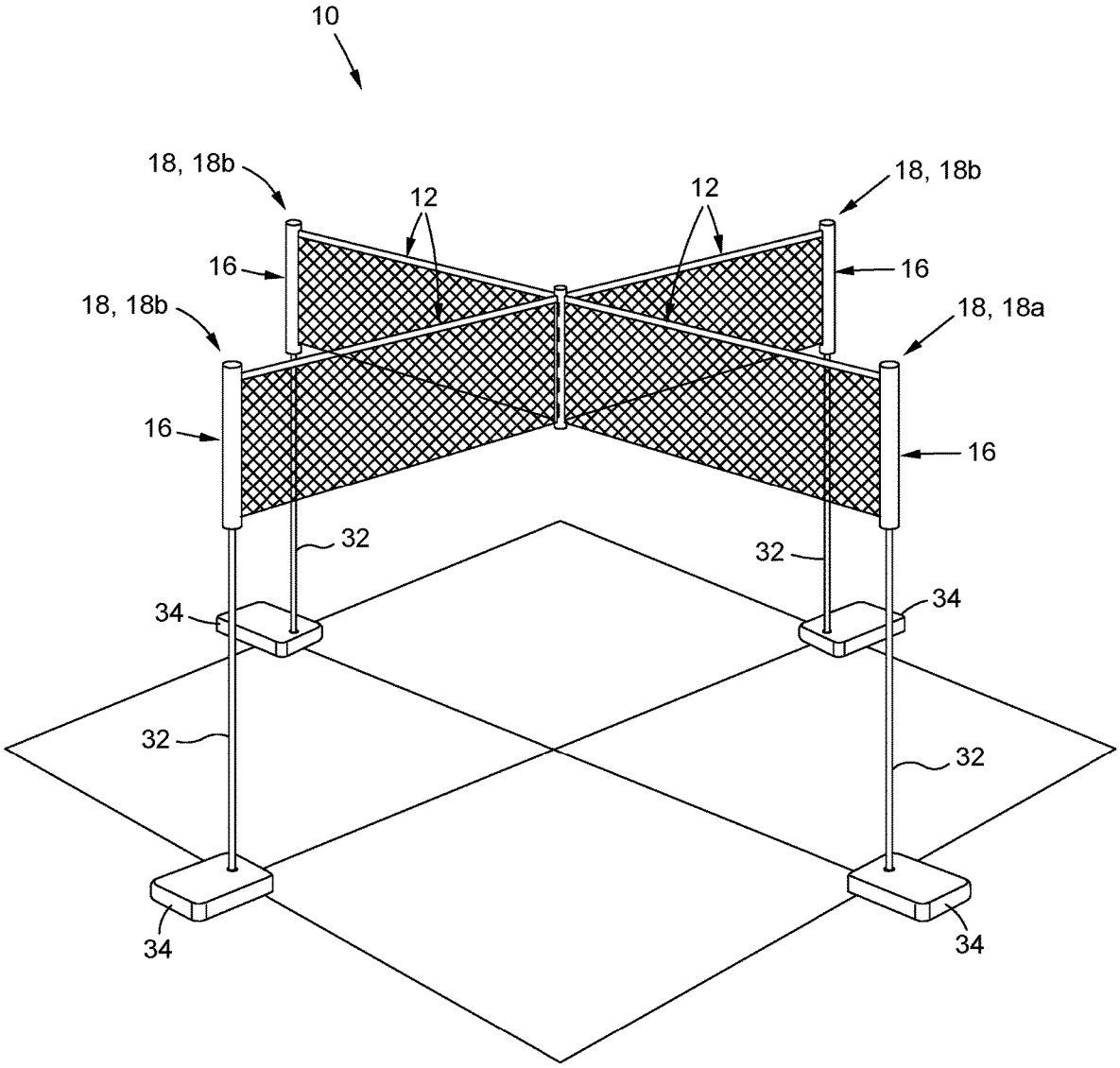
FIG. 1 is an upper perspective view of one embodiment of a four-sided net apparatus in an extended configuration.

The detailed description set forth below in connection with the appended drawings is intended as a description of certain embodiments of a retractable sports net and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings wherein the showings are for purposes of illustrating a preferred embodiment of the present disclosure, and are not for purposes of limiting the same, there is depicted a selectively deployable sports net apparatus 10 having a plurality of interconnected net segments 12. Each net segment 12 is attached to a connector 14 which may connect with at least one corresponding connector 14 of an adjacent net segment 12. In this regard, several different combinations of net segments 12 may be interconnected to divide a playing court into a number of different playing zones. For instance, two net segments 12 may be interconnected to divide the playing court into two zones. Three net segments 12 may be interconnected to divide the playing court into three zones. Four net segments 12 may be interconnected to divide the playing court into four zones, and so forth.

Each net segment 12 may be retractably connected to a spool located within a respective housing 16, such that when the net segment 12 is not in use, the net segment 12 may be retracted within the housing 14. However, the net segment 12 may be extended out of the housing 14 to deploy the net segment 12 for use. Thus, the ability to extend and retract the net segments 12 relative to the housing 16 may allow for quick and easy setup and take down of the net apparatus 10. Furthermore, the ability to retract the net segment 12 within the housing 16 may allow for convenient storage thereof. By retracting the net segment 12 within the housing 16, the net segment 12 is less likely to snag or become entangled on nearby objects, such as when stored in a garage or the trunk of a vehicle.

Figure 2:
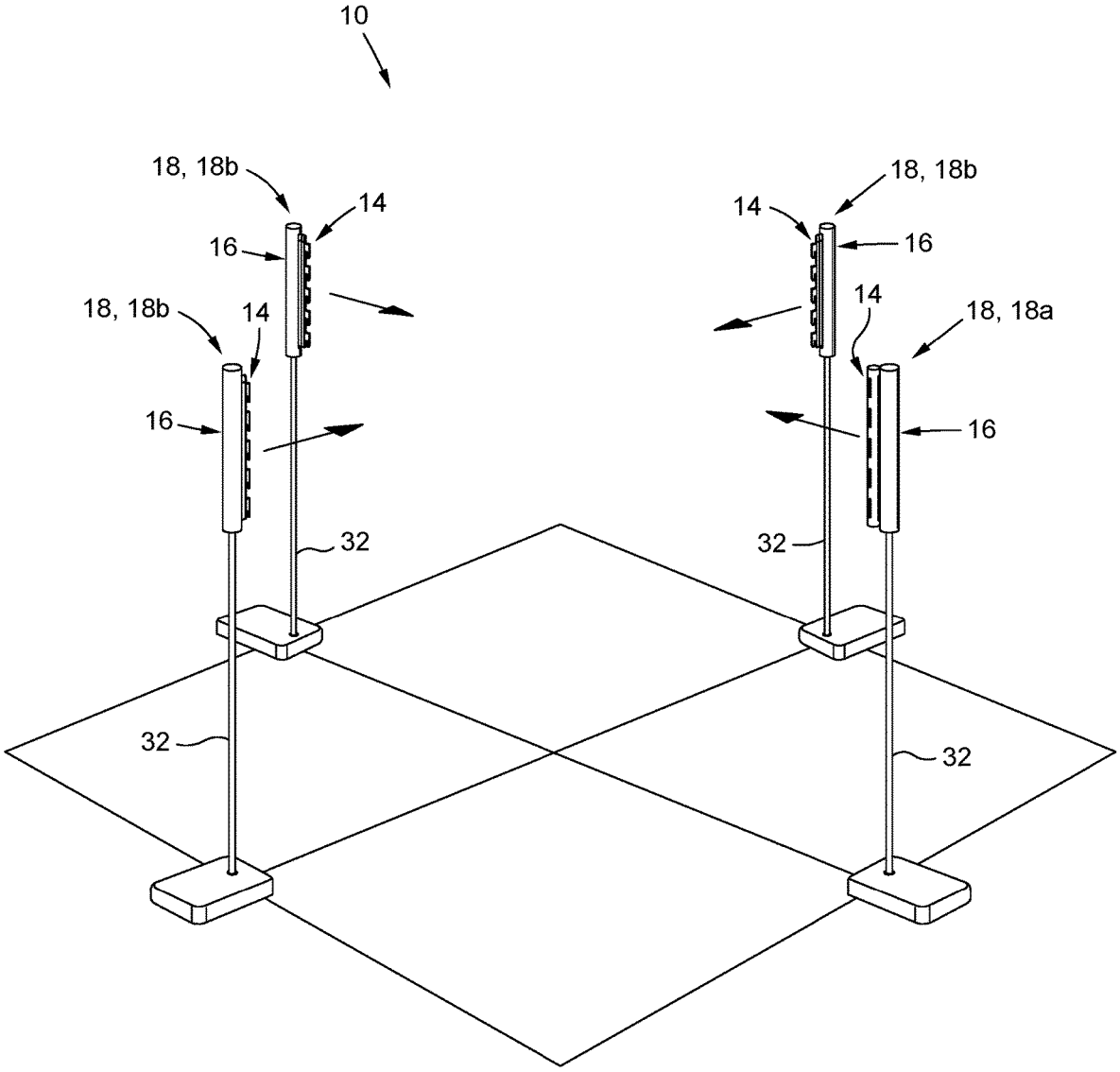
FIG. 2 is an upper perspective view of the net apparatus of FIG. 1, with the net apparatus having been transitioned to a retracted configuration.

FIGS. 1 and 2 depict a net apparatus 10 having four net modules 18 that may be interconnected to each other over a playing court to divide the playing court into equal quarters. Each module 18 may include a housing 16, a net segment 12, and a connector 14. FIG. 1 shows the four net modules 18 connected via their deployed net segments 12, while FIG. 2 shows the four net modules 18 disconnected with each net segment 12 having been retracted in a respective housing 16.

Figure 3:
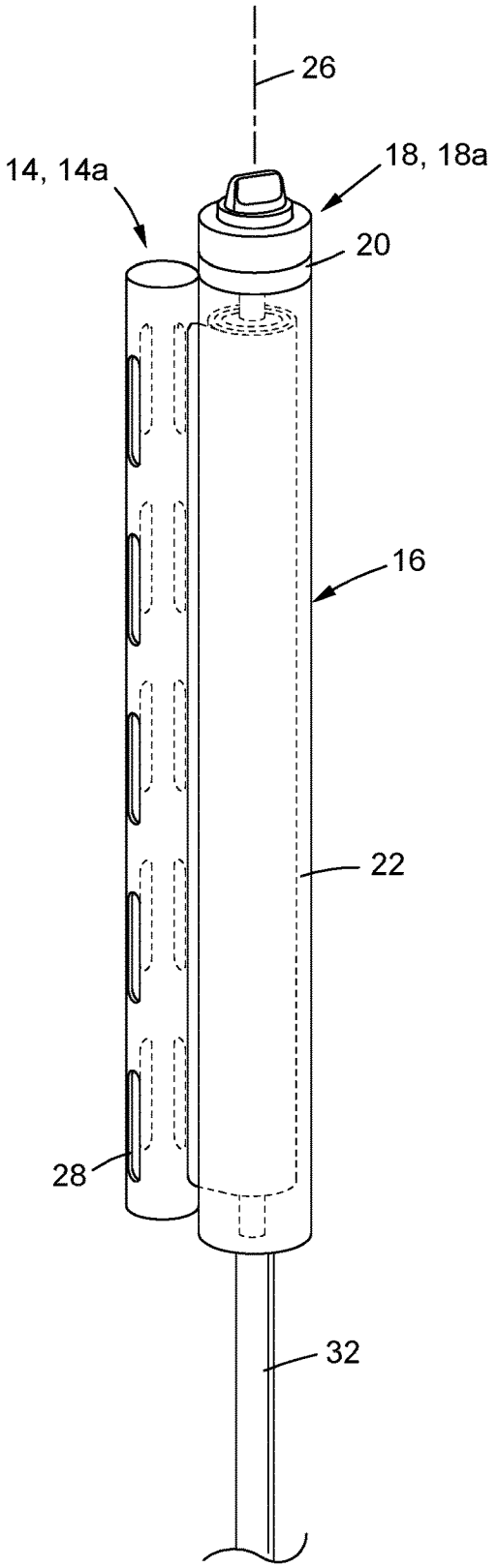
FIG. 3 is an upper perspective view of a base module used in the net apparatus.
Figure 4:
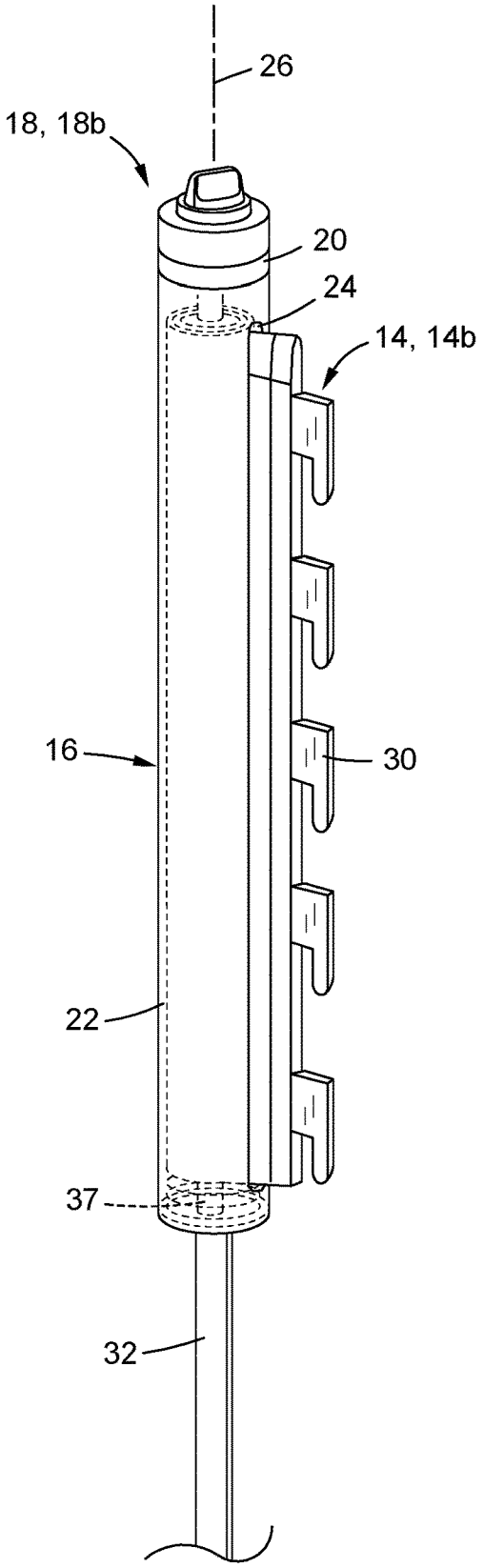
FIG. 4 is an upper perspective view of an auxiliary module used in the net apparatus.

According to one embodiment, the net apparatus 10 includes a base module 18*a* and three auxiliary modules 18*b*. FIG. 3 shows a base module 18*a* in a retracted state, while FIG. 4 shows an auxiliary module 18*b* in a retracted state. The primary distinction between the base module 18*a* and the auxiliary modules 18*b* relates to the respective connectors 14. In particular, the base module 18*a* includes a base connector 14*a*, while the auxiliary module 18*b* includes an auxiliary connector 14*b*. As will be explained in more detail below, the base connector 14*a* may be configured to connect with several auxiliary connectors 14*b*, while each auxiliary connector 14*b* may be configured to engage with a base connector 14*a*. In other words, the base connector 14*a* may not engage with another base connector 14*a*, and the auxiliary connectors 14*b* may not engage directly with other auxiliary connectors 14*b*.

Each housing 16 may include a top wall 20 and a sidewall 22 extending from the top wall 20 to define an interior cavity. The sidewall 22 may include a slit 24 formed therein, which may extend axially along a length of the housing 16. The slit 24 may be in communication with the interior cavity to allow for passage of the net segment 12 therethrough as the net segment 12 is transitioned between extended and retracted configurations. In one embodiment, the housing 16 defines a central axis 26 about which the top wall 20 and sidewall 22 are disposed. The slit 24 formed in the sidewall 24 may extend longitudinally in a generally parallel direction relative to the central axis 26, and generally perpendicular to the top wall 20.

Inside of each housing 16, there may be included a retraction mechanism which may be connected to the corresponding net segment 12. For instance, the retraction mechanism may include a spool 37 that is connected to a spring, which urges the spool 37 to rotate in a first direction, e.g., a direction of retraction. The net segment 12 may be connected to the spool 37, such that when the net segment 12 is in the retracted position, the net segment 12 is wound around the spool 37. Transitioning the net segment 12 from the retracted position toward the extended position may cause a portion of the net segment 12 to unwind from the spool 37 and extend out of the slit 24. In this regard, the interconnection between the spring and the spool 37 may allow for rotation of the spool 37 in a second direction, e.g., a direction of extension, when the net segment 12 is pulled out of the housing 16 by a force having a magnitude that overcomes the biasing force. The biasing force on imparted on the net segment 12 by the retraction mechanism may keep the net segment 12 taut during use. As such, an undesirable saggy net may be mitigated by the retraction mechanism.

Figure 4A:
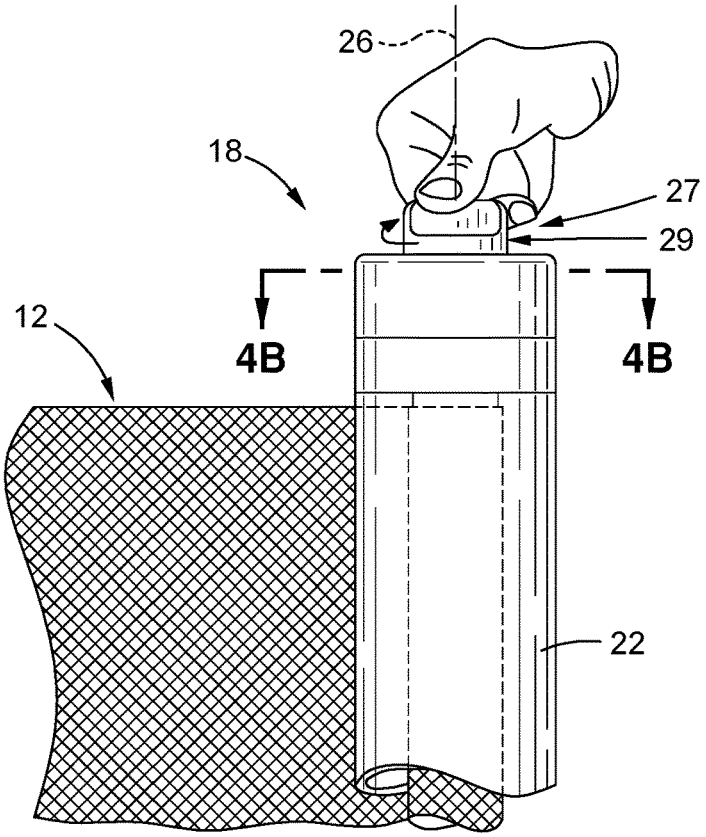
FIG. 4A is a partial side view of a user engaging a locking mechanism for locking/unlocking a spool attached to a net segment.
Figure 4B:
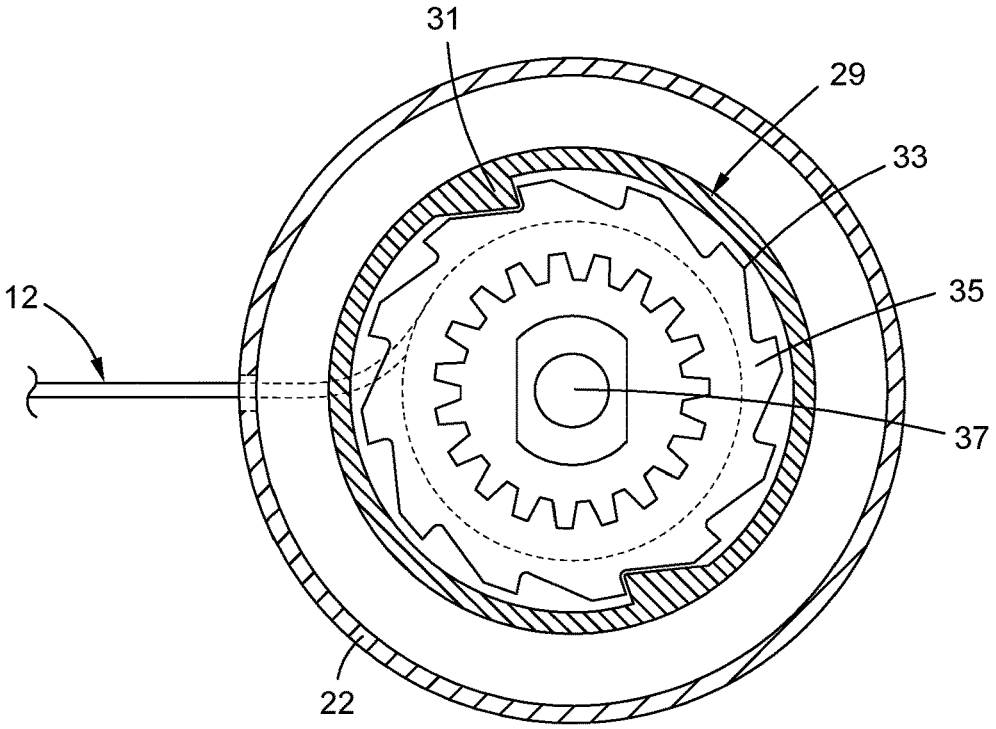
FIG. 4B is a top cross sectional view of the locking mechanism depicted in FIG. 4.

The retraction mechanism may be operatively associated with a locking mechanism 27 which may lock the retraction mechanism in place to avoid undesired retraction (or possible extension) of the net segment 12. Referring now to FIGS. 4A and 4B, one embodiment of the locking mechanism 27 includes a hand dial 29 that may be turned relative to the housing 16 to either lock or unlock the locking mechanism 27. The hand dial 29 may include a cylindrical wall that includes inner teeth or serrations 31 that are engageable with outer teeth or serrations 33 formed on a gear 35 attached to the spool 37. The hand dial 29 may be selectively positionable relative to the gear 35 to bring the inner serrations 31 into engagement or out of engagement with the outer serrations 33. When the inner serrations 31 on the hand dial 29 are engaged with the outer serrations 33 of the gear 35, the locking mechanism 27 is locked and the spool 37 may be prevented from rotating. Conversely, when the inner serrations 31 of the hand dial 29 are disengaged from the outer serrations 33 of the gear 35, the locking mechanism 27 may be unlocked and the spool 37 may freely rotate. The hand dial 29 may be moveable along the central axis 26 (e.g., in an upward and downward motion when viewed from the perspective shown in FIG. 4A) to facilitate the selective engagement or disengagement. A spring may be operatively connected to the hand dial 29 to bias the hand dial 29 into the disengaged position, such that a user may be required to press on the hand dial 29 to move that hand dial 29 toward engagement with the gear 35. It is also contemplated that the hand dial 29 may be twisted when pressed downwardly to bring the inner serrations 31 into engagement with the outer serrations 33.

Although the foregoing describes the locking mechanism 27 as including the hand dial 29 and gear 35, other configurations of the locking mechanism 27 may also be used without departing from the sprit and scope of the present disclosure. For instance, the locking mechanism may include a ratcheting gear connected to the spool, and a pawl that interfaces with the ratcheting gear. The configuration of the ratcheting gear and pawl may be such as to allow for generally unrestricted rotation of the spool in the direction of extension, while preventing undesirable rotation of the spool in the direction of retraction. The pawl may be moveable to a disengaged position relative to the ratcheting gear to allow for rotation in the first direction. Transition of the pawl from an engaged configuration to the disengaged configuration may be facilitated by a manually actuated lever, switch, button, etc., operatively coupled to the pawl, or via movement of the net segment 12. For instance, extension of the net segment 12 into a hyper-extended position may release the pawl from the ratcheting gear.

The net segment 12 may be retracted into its respective housing 16 when the external force (e.g., the pulling force) applied to the net segment 12 in opposition to the retraction force may be decreased or removed entirely, e.g., if the user releases the net segment 12, the biasing force causes the spool 37 to rotate in a direction which causes retraction of the net segment 12 around the spool 37.

Referring again specifically to FIGS. 3 and 4, there is depicted an exemplary embodiment of the base connector 14*a*, and auxiliary connector 14*b*, respectively. The base connector 14*a* may include a hollow cylindrical body having a plurality of openings 28 formed therein. Each opening 28 may extend from an outer surface to an inner surface and may be generally elongate in shape. The openings 28 may be arranged in vertical or longitudinal arrays or groupings, with the openings 28 of a given array being aligned along a common axis. Each array may accommodate attachment with a corresponding auxiliary connector 14*b*. Thus, by forming multiple arrays of openings 28 on a single base connector 14*a*, attachment to multiple auxiliary connectors 14*b* may be facilitated. In the exemplary embodiment, each array includes five openings 28 at similar axial locations on the base connector 14*a*. In this regard, from the perspective shown in FIG. 3, a bottommost opening 28 for each array is centered at a first circumferential height, an adjacent opening 28 in each array is centered at a second circumferential height, and so forth. The base connector 14*a* shown in FIG. 3 includes three sets of arrays, spaced at 90 degrees, 180 degrees, and 270 degrees from the base net segment 12, which may accommodate a four-sided net apparatus 10 with net segments 12 at ninety-degree angles to each other. However, any number of arrays may be included on the base connector 14*a* without departing from the spirit and scope of the present disclosure. For instance, the base connector 14*a* may include two (2) arrays spaced at 120 degrees and 240 degrees relative to the base net segment 12, which may accommodate a three-sided net apparatus 10 with net segments 12 at 120 degree angles to each other. It is also contemplated that the base connector 14*a* may include several arrays to accommodate a number of different net apparatus 10 configurations. For instance, the base connector 14*a* may be configured to accommodate a net apparatus 10 including two net segments 12, three net segments 12, four net segments 12, etc. In this regard, the base connector 14*a* may include arrays at 90 degrees, 120 degrees, 180 degrees, 240 degrees and 270 degrees relative to the base net segment 12. The 90, 180, and 270 degree arrays may be intended for a 4-sided configuration, while the 120 and 240 degree arrays may be intended for a 3-sided configuration. However, it is understood that auxiliary net segments 12 may be connected to any array, and thus, if a user wanted to create unequal playing zones, the auxiliary net segments 12 may be connected to unequally spaced arrays.

The auxiliary connector(s) 14*b* may be complementary to the base connector 14*a* to facilitate detachable engagement therewith. In the exemplary embodiment, the auxiliary connector 14*a* includes a series of hooks 30 that may be received within a given array of openings 28 formed within the base connector 14*a*. The hooks 30 may include a finger that may extend within the hollow interior of the base connector 14*a* when the auxiliary connector 14*b* is engaged with the base connector 14*a*. The number of hooks 30 included on a given auxiliary connector 14*b* may be identical to the number of openings 28 in a given array on the base connector 14*a*.

Figure 5:
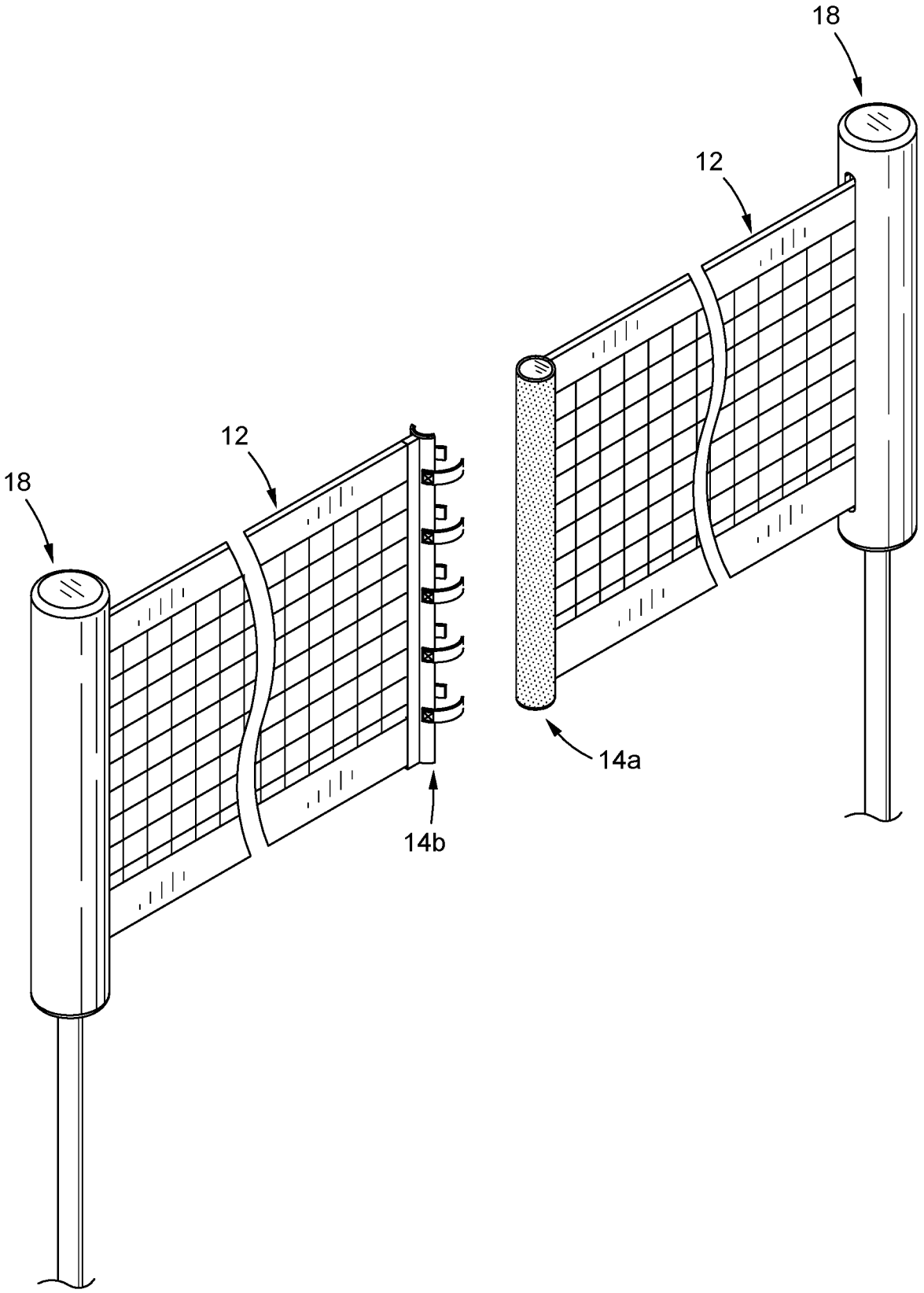
FIG. 5 is an upper perspective view of the net apparatus having connectors fitted with complementary hook and loop material.
Figure 6:
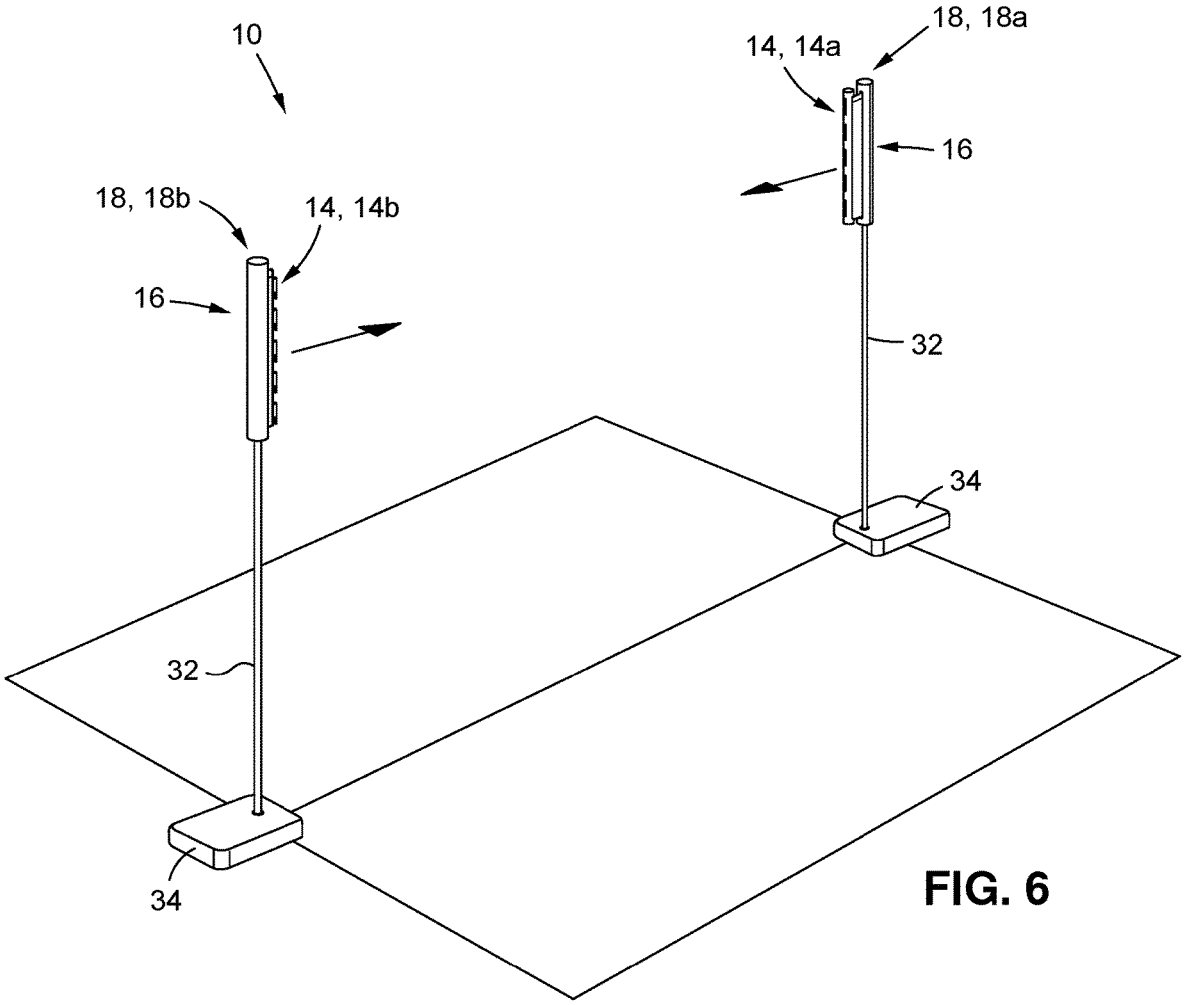
FIG. 6 is an upper perspective view of a net apparatus in a retracted configuration and arranged for deployment in a single plane configuration.
Figure 7:
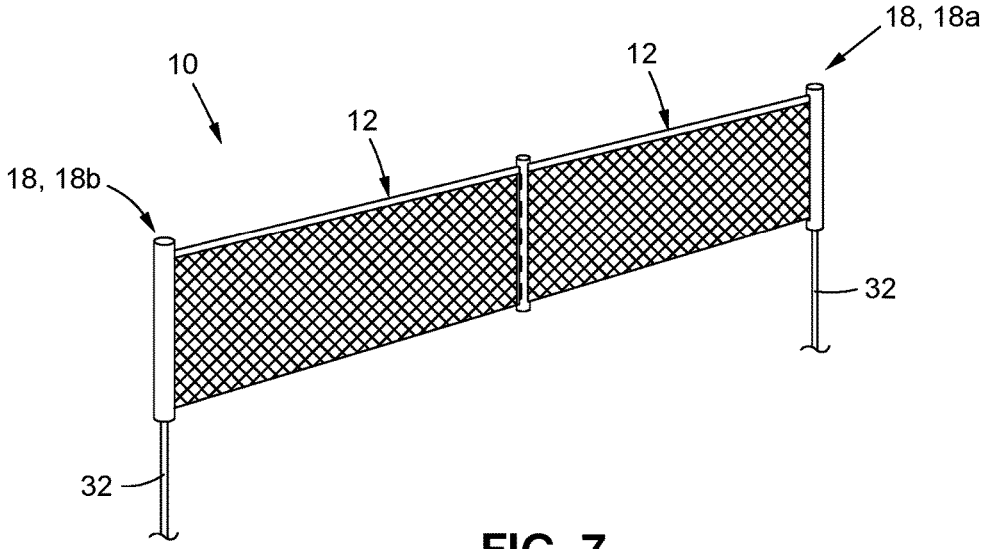
FIG. 7 is an upper perspective view of the net apparatus of FIG. 6 in the extended configuration

Although the embodiment depicted in FIGS. 3 and 4 includes openings 28 formed on the base connector 14*a* and hooks 30 formed on the auxiliary connector 14*b*, it is contemplated that other embodiments may include a reverse configuration, e.g., with the base connector 14*a* including hooks 30 and the auxiliary connector 14*b* including openings 28. Moreover, it is contemplated that other mechanical connectors known by those skilled in the art may also be used to connect the base connector 14*a* to the auxiliary connector 14*b*. For instance, hook and loop fasteners (e.g., VELCRO™), magnets, snaps, tongue and groove connectors may also be used. FIG. 5 depicts an alternative embodiment showing an example of hook and loop fasteners used to connect adjacent net segments together. In particular, the base connector 14*a* includes a cylindrical outer surface covered with hook and loop material, and the auxiliary connector 14*b* may include one or more strips of complementary hook and loop material engageable with the base connector 14*a* to facilitate connection with the base connector 14*a*.

Each housing 16 may be connected to a support pole 32 to elevate the net segment 12 above the court or playing surface. The support pole 32 may be detachably engageable to the housing 16, such as via threaded engagement, a removeable pin, or other detachable engagement mechanisms known in the art. However, it is also contemplated that the support pole 32 may be mounted more permanently to the housing 16, such as via an adhesive. Each support pole 32 may include an enlarged foot 34 to enhance stability of the net apparatus 10.

With the basic structure of the net apparatus 10 having been described above, the following discussion pertains to an exemplary use of the net apparatus 10. To set up the net apparatus 10, a user obtains the desired number of net modules 18 for the net apparatus 10. For instance, if a four-sided net apparatus 10 is desired, the user should obtain four net modules 18, including one base module 18*a* and three auxiliary modules 18*b*.

Once the required/desired number of net modules 18 are obtained, the user extends the net segment 12 of the base module 18*a* and the net segment 12 of at least one auxiliary module 18*b*. To extend the net segments 12, the user may pull on the base connector 14*a* and auxiliary connector 14*b*, respectively, or any portion of the net segment 12 that may be extending out of the housing 16 to increase the distance between the connector 14 and is respective housing 16. The extended net segments 12 may be engaged by advancing the hooks 30 on the auxiliary connector 14*b* through respective openings 28 formed on the base connector 14*a*. The user may connect any remaining auxiliary net module 18*b* to the base module 18*a* by extending the net segments 12 and engaging the auxiliary connector(s) 14*b* to the base connector 14*a*.

Although the foregoing describes extending the net segments 12 prior to engaging the connectors 14, it is understood that the opposite sequence may occur. In particular, the connectors 14 may be engaged, and then the net segments 12 may be extended.

With the net segments 12 extended and the connectors 14 engaged, the user may position the net apparatus 10 over the playing surface, with the support poles 32 being placed at the periphery of the playing surface. The net apparatus 10 may be configured such that the net apparatus 10 may remain elevated above the playing surface with no center support pole. In this regard, there may be no support pole extending along a central axis, from which the net segments radiate. In other words, there may be no support pole directly connected to the base connector 14*a* and/or auxiliary connector(s) 14*b*.

When the net apparatus 10 is assembled, the net apparatus 10 may be used to play a game combining the features of conventional volleyball and four square, as explained in U.S. Pat. No. 9,504,892, entitled Game Apparatus and Method of Playing the Same, the contents of which are expressly incorporated herein by reference.

To disassemble the net apparatus 10, the net segments 12 are retracted and the auxiliary connectors 14*b* are disconnected from the base connector 14*a*. When the net segments 12 are retracted, each connector 14 may be moved closer to its corresponding housing and the net segments 12 may be wound around the spool 37 or axle located within the housing 16 to mitigate tangling of the net segments 12. It is contemplated that the auxiliary connectors 14*b* may be disconnected from the base connector 14*a* prior to retraction of the corresponding auxiliary net segment 12 into the housing 16. Alternatively, the net segments 12 may be retracted and then the auxiliary connectors 14*b* may be disengaged from the base connector 14*a*.

If the support poles 32 are detachable from the housings 16, the user may detach the support poles 32 to facilitate storage of the net apparatus 10.

When the net apparatus 10 is taken down, the net modules 18 may be easily stored within a vehicle, garage, storage shed, etc., with the net segments 12 entirely or substantially contained within their respective housings 16. Snagging of the net segments 12 on adjacent equipment is mitigated by the containment of the net segments 12 within the housings 16. As such, when the user wants to use the net apparatus 10 again, the net apparatus 10 may remain in an easily deployable and ready to use configuration.

Figure 8:
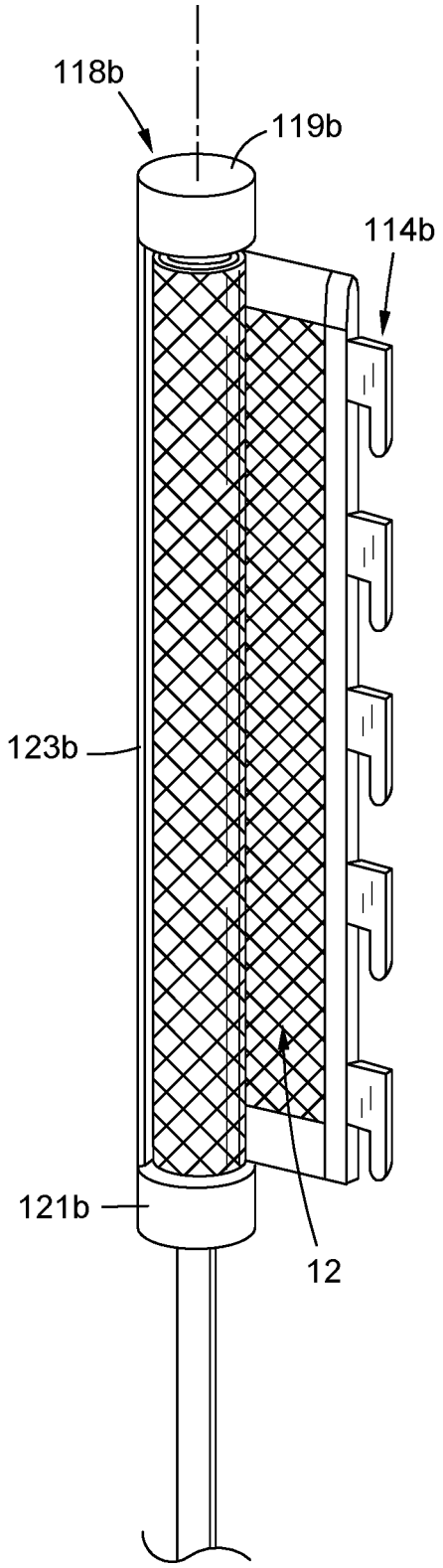
FIG. 8 is an upper perspective view of another embodiment of an auxiliary module wherein the net segment is exposed when in the retracted position.
Figure 9:
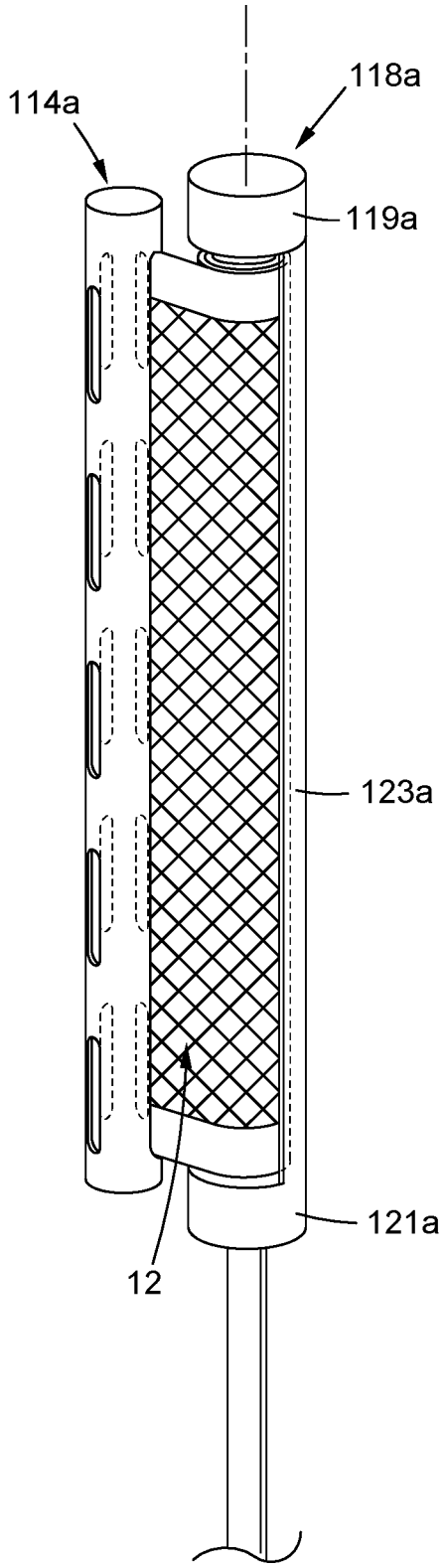
FIG. 9 is an upper perspective view of a base module wherein the net segment is exposed when in the retracted position.

Referring now to FIGS. 8 and 9, there is depicted another embodiment of an auxiliary module 118*b* (see FIG. 8) and a base module 118*a* (see FIG. 9), wherein the modules 118*a*, 118*b* are specifically configured or adapted such that the net segment 112 of each module 118*a*, 118*b* may be at least partially exposed or uncovered when the net segment 112 is in the retracted configuration. In this regard, it is contemplated that the modules 118*a*, 118*b* may be formed without a housing, or alternatively, a very minimal housing.

In the embodiment depicted in FIG. 8, the auxiliary module 118*b* includes an upper body 119*b*, a lower body 121*b*, and a guide strap 123*b* extending between the upper body 119*b* and the lower body 121*b*. The upper and lower bodies 119*b*, 121*b* depicted in FIG. 8 are cylindrical, although other shapes, such as quandrangular, triangular, etc., are also contemplated. The guide strap 123 may be rigid or flexible and may assist in gathering the net segment 12 as it is retracted. A spool or rod may extend between the upper and lower bodies 119*b*, 121*b* and may be connected to the net segment 112, which in turn, in connected to the auxiliary connector 114*b*. The spool or rod may rotate relative to the upper and lower bodies 119*b*, 121*b* as the net segment 112 is extended and retracted.

The base module 118*a* shown in FIG. 9 is similar, in that it also includes an upper body 119*a*, a lower body 121*a*, and a guide strap 123*a* extending between the upper body 119*a* and the lower body 121*a*. A spool or rod may extend between the upper and lower bodies 119*a*, 121*b* and may be connected to the net segment 112, which in turn, in connected to the base connector 114*a*. The spool or rod may rotate relative to the upper and lower bodies 119*a*, 121*a* as the net segment 112 is extended and retracted.

Although the embodiments of the modules 118*a*, 118*b*, shown in FIGS. 8 and 9 include a guide strap 123*a, b*, it is contemplated that other embodiments may be formed without a guide strap 123*a, b* or a housing. In this regard, various embodiments may be formed without anything extending between an upper housing, end cap or body, and a corresponding lower housing, end cap or body, except for a central spool around which the net segments 12 may gather as they are retracted.

Figure 10:
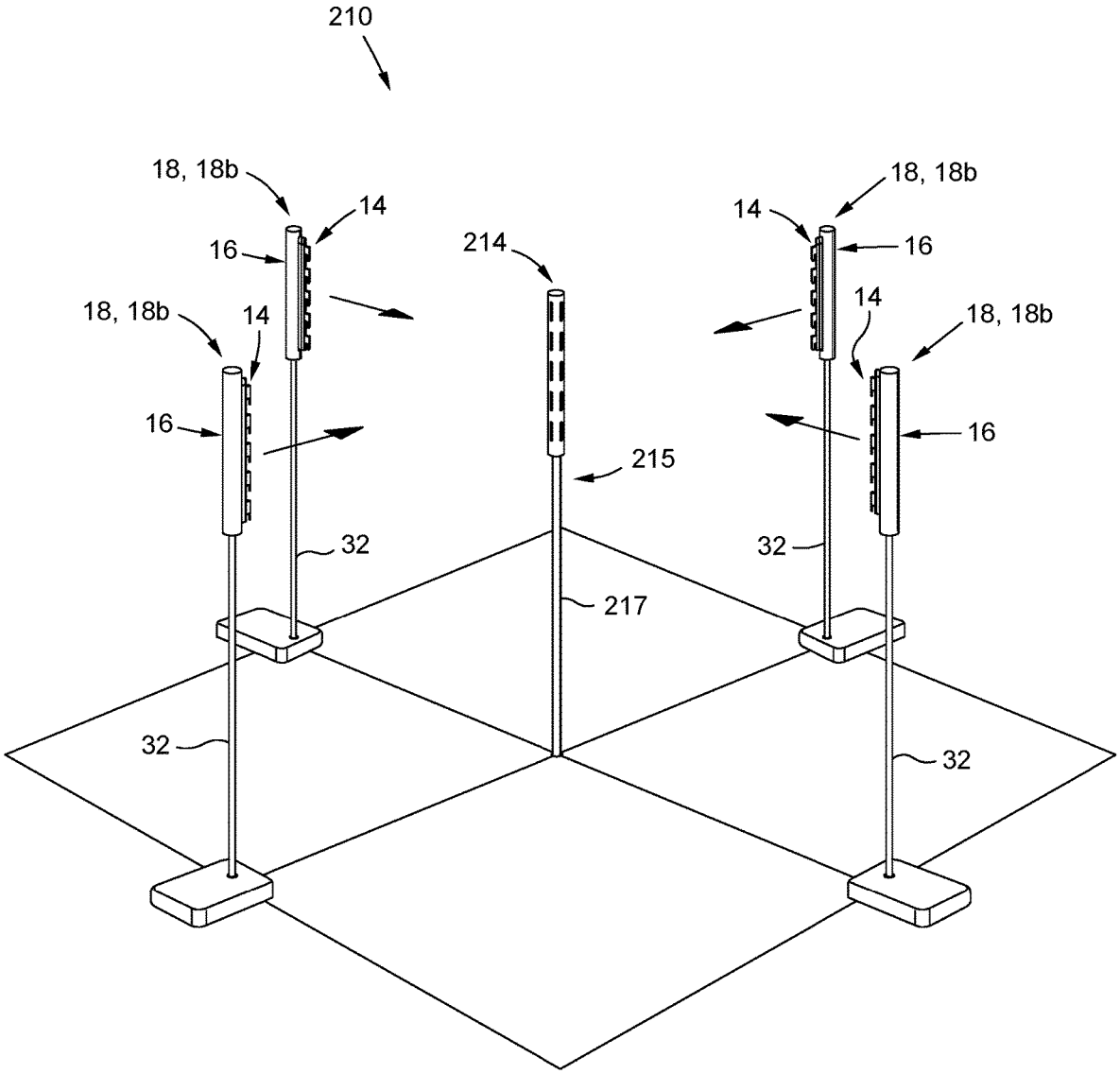
FIG. 10 is an alternative embodiment of a net apparatus including a center pole having a base connector integrated therein and configured to connect with multiple net modules.

Referring now to FIG. 10, there is depicted another embodiment of a net apparatus 210 that includes a center pole 215 connectable to one or more net modules 18 for supporting the net(s) above a playing surface. Each of the net modules 18 included in the net apparatus 210 shown in FIG. 10 are auxiliary net modules 18*b*, described in more detail above. The center pole 215 includes a base connector 214 from which a rod or shaft 217 extends. The base connector 214 is similar in configuration to the base connector 14*a* described above, particularly in its ability to engage with the auxiliary connectors 14*b* on the auxiliary net modules 18*b*. The rod or shaft 217 is connectable to the ground to position the base connector 214 at approximately the same height as the auxiliary connectors 14*b* on the net modules 18. Alternatively, the shaft 217 may be connected to a foot or base plate which rests on the ground and allows the shaft 217 to extend upwardly from the ground.

The use of the center pole 215 may provide more central support to the net apparatus 210, if so desired. In addition, the center pole 215 may allow for use of the net apparatus 210 without a base net module 18*a*. Thus, in the event a base net module 18*a* becomes lost or damaged, a center pole 215 may be used to connect multiple auxiliary net modules 18*b*. Accordingly, the center pole 215 may provide enhanced structural support, as well as enhanced functional adaptability.

Although the embodiment depicted in FIG. 10 includes rod or shaft 217 extending from the base connector 214 to support the base connector 214 over the ground, it is contemplated that in other embodiments, the base connector 214 may be used without rod or shaft 217 such that when the base connector 214 is attached to at least two net modules 18*b*, the base connector 214 may be supported above the ground due to the interconnection to the net modules 18*b*. In other words, when the base connector 214 is connected to the net modules 18*b*, the tension in the net modules 18*b* may support the base connector 214 over the ground without anything extending directly below the base connector 214 (e.g., independent of any additional support structure along a central axis defined by the base connector 214).

It is further contemplated that the rod or shaft 217 may be detachably engaged with the base connector 214 to allow for engagement between the shaft 217 and the base connector 214 when desired, and detachment of the shaft 217 from the base connector 214 when desired. For instance, it may be desirable to have the shaft 217 engaged to the base connector 214 when setting up the net apparatus 210 to ensure the net apparatus 210 is set up centrally over a playing court, and to minimize the number of individuals that may be required to set up the net apparatus 210 (e.g., it may be possible for a single individual to set up the net apparatus 210). However, after the net apparatus 210 has been assembled, the tension in the net modules 18*b* may provide sufficient support to the base connector 214, to allow for detachment of the shaft 217 from the base connector 214. Removal of the shaft 217 from the base connector 215 may remove a possible obstruction when playing with the net apparatus 210. The detachable engagement may be facilitated via threaded interconnection between the shaft 217 and the base connector 124, spring detent connection, friction fit, or other mechanical interconnections known by those skilled in the art.

Figure 11:
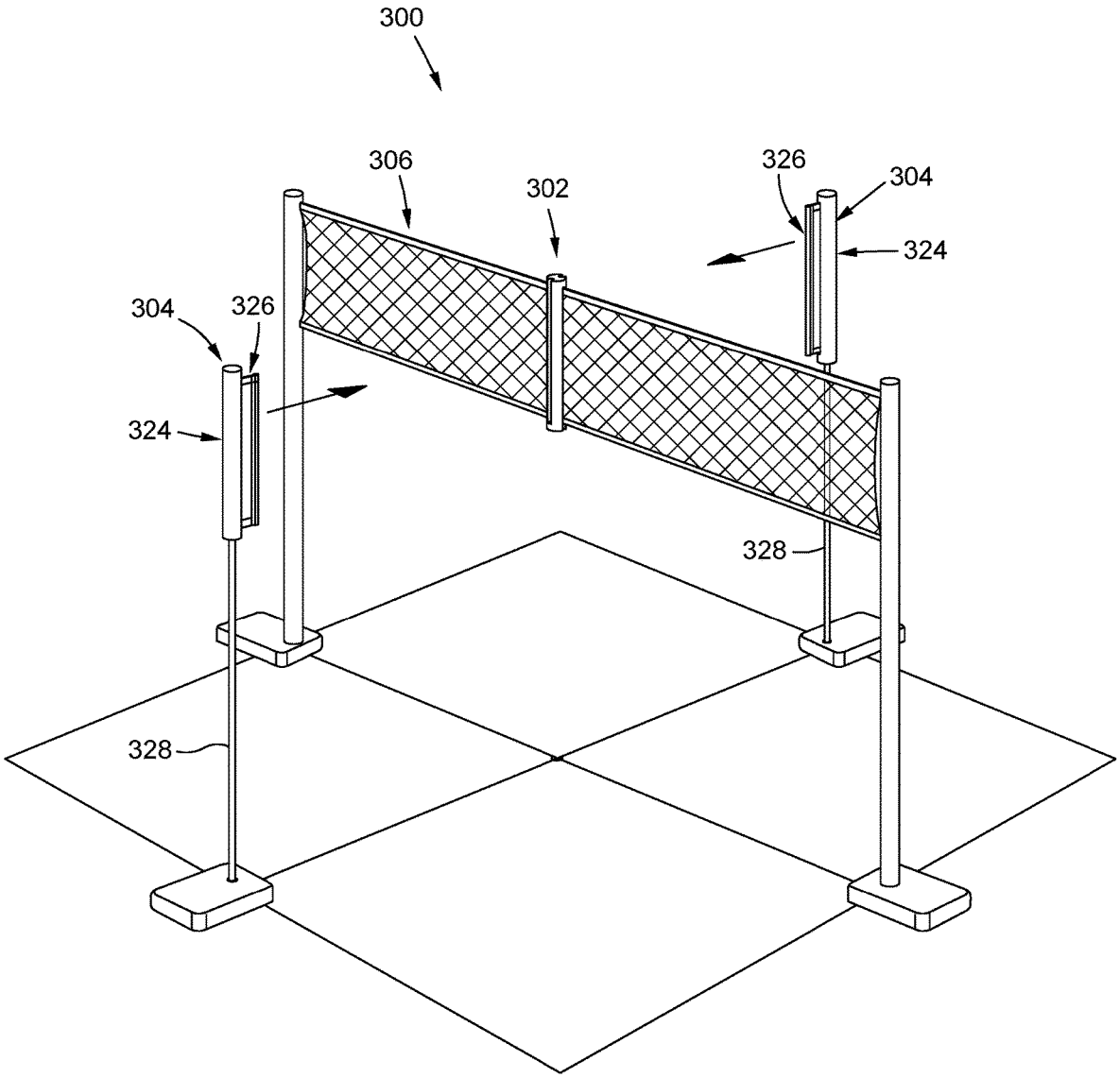
FIG. 11 is an upper perspective view of another embodiment of an adaptor and a pair of net segments operatively connectable with a conventional volleyball net, the pair of net segments being shown as being disengaged from the adaptor.
Figure 12:
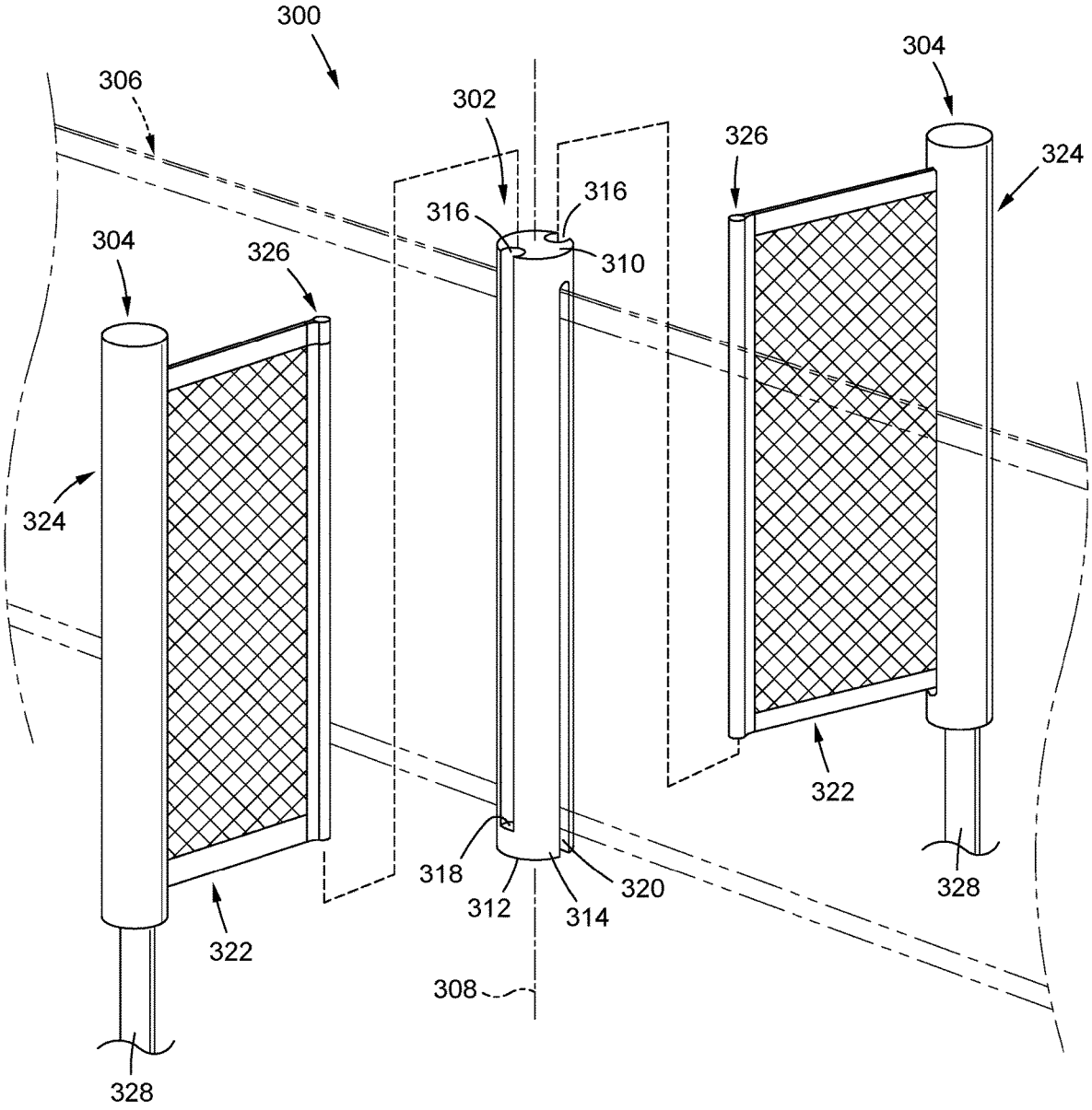
FIG. 12 is an enlarged upper perspective view of the adaptor and net segments depicted in FIG. 11, with the net segments having been partially extended from their positions shown in FIG. 11.

Referring now to FIGS. 11-12, there is depicted another embodiment of a multi-sided net system 300 including a hub 302 specifically configured and adapted to facilitate attachment of one or more net modules 304 to an existing volleyball net 306, badminton net, tennis net, or other planar sports nets known in the art. In this regard, for those users already in possession of an existing sports net 306, the hub 302 may be a useful add-on to enhance the overall utility of the existing sports net 306.

The hub 302 may be generally cylindrical in nature and define a longitudinal axis 308. The hub 302 includes a generally circular upper face 310, an opposing generally circular lower face 312, and an outer sidewall 314 extending between the upper and lower faces 310, 312. The hub 302 additionally comprises a pair of channels 316 extending into the hub 302 (e.g., radially inward) from the sidewall 314 and axially from the upper face 310 toward the lower face 312 in diametrically opposed relation to each other in a direction that is generally parallel to the longitudinal axis 308. Each channel 316 may terminate in spaced relation to the lower face 312 to define a shoulder 318, the importance of which will be described in more detail below. Although the exemplary embodiment includes a pair of channels 316, it is contemplated that in other embodiments, the hub 302 may include a single channel 316 or more than two channels 316, e.g., three, four, five, etc.

The hub 302 additionally includes a slot 320 extending from the lower face 312 toward the upper face 310 along a plane that divides the hub 302 into approximately two equal halves. The slot 320 is sized to receive at least a portion of the existing volleyball net 306 to allow the hub 302 to be slid over the top of the existing volleyball net 306.

The hub 302 is adapted to be used in connection with one or more net modules 304, which may generally include a net segment 322 and a housing 324, as described in more detail above. The net module 304 may additionally include a module connector 326 that is configured to be engageable with the hub 302. In the embodiment shown in FIGS. 11-12, the module connector 326 includes a rib sized to be slidably received in a respective channel 316 formed on the hub 302. Furthermore, the rib 326 may be of a length such that when the rib 326 is completely inserted into the channel 316, it contacts the shoulder 318, which may result in the top of the net segment 322 being generally aligned with the top of the volleyball net 306.

With the basic structure of the hub 302 and net modules 304 having been described, the following discussion relates to an exemplary use thereof. A user may setup the existing volleyball net 306 between a pair of support poles in a conventional manner. Ideally, the volleyball net 306 is taut or stretched to remove slack when attached to the support poles.

After the volleyball net 306 has been set up, the user may place the hub 302 onto the volleyball net 306, preferably at a midsection of volleyball net 306. The hub 302 may be placed on the volleyball net 306 by aligning the net 306 (e.g., the plane of the net) with the slot 320 on the hub 302 and advancing the net 306 through the slot 320 until the hub 302 rests on the net 306. When the hub 302 is connected to the net 306, the channels 316 on the hub 302 may be located on opposite sides of the net 306.

With the volleyball net 306 assembled, and the hub 302 being placed on the volleyball net 306, the user may assemble the net modules 304. In particular, each net module 304 may include a support pole 328 that may be placed in, or on, the ground. The net segment 322 may be extended from its housing 324 and the module connector 326 may be advanced into a respective channel 316 on the hub 302. In particular, the module connector 326 may advanced into the channel 316 until the module connector 326 contacts, or rests against, the shoulder in the channel 316. A biasing element or spring may impart a biasing force on the net segment 322 that may create tension in the net segment 322 to keep the net segment 322 taut when extended between the housing 324 and the hub 302.

When both net segments 322 are connected to the hub 302, a four-sided net assembly 300 may be collectively defined by the existing volleyball net 306, and the pair of net modules 304. In particular, the volleyball net 306 may define two-sides by the portions of the volleyball net 306 extending on opposite sides of the hub 302. The other two-sides may be defined by the net segments 322 of the net modules 324.

To disassemble the net assembly 300, the user removes the module connectors 326 from their respective channels 316, and retracts the net segments 322 into their housings 324. The hub 302 may be removed from the volleyball net 306 and the volleyball net 306 may be taken down.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An add-on net system configured for use with an existing net, the add-on net system comprising:

a hub configured to be placeable on the existing net to be supported by the existing net;

a first net module including a first spool, a first net, and a first connector connected to the first net, the first connector being detachably engageable with the hub, the first net being retractably connected to the first spool such that the first net defines an extended length as a distance between the first spool and the first connector, the first net being transitional relative to the first spool between an extended position and a retracted position, the extended length increasing as the first net transitions from the retracted position toward the extended position; and a second net module including a second spool, a second net, and a second connecter connected to the second net, the second connector being detachably engageable with the hub, the second net being retractably connected to the second spool such that the second net defines an extended length as a distance between the second spool and the second connector, the second net being transitional relative to the second spool between an extended position and a retracted position, the extended length increasing as the second net transitions from the retracted position toward the extended position.

2. The net system recited in claim 1, further comprising:

a first housing connected to the first spool, the first housing defining a cavity sized to receive a retracted portion of the first net gathered around the first spool; and a second housing connected to the second spool, the second housing defining a cavity sized to receive a retracted portion of the second net gathered around the second spool.

3. The net system recited in claim 2, wherein:

the first housing includes a slot formed therein, the slot being sized to allow for passage of the first net therethrough, and the second housing includes a slot formed therein, the slot being sized to allow for passage of the second net therethrough.

4. The net system recited in claim 1, wherein the first spool is rotatable in a first direction to facilitate transition of the first net from the extended position toward the retracted position and a second direction to facilitate transition of the first net from the retracted position toward the extended position, the net system further comprising a first spring coupled to the first spool to bias the first spool to rotate in the first direction.

5. The net system recited in claim 4, further comprising a first locking mechanism operatively engageable with the first spool and selectively transitional between a locked configuration and an unlocked configuration, the first locking mechanism being configured to prevent rotation of the first spool in the first direction when the first locking mechanism is in the locked configuration, the first spool being unhindered by the first locking mechanism when the first locking mechanism is in the unlocked configuration.

6. The net system recited in claim 1, further comprising a first pole connectable to the first spool to extend parallel to the first spool and a second pole connectable to the second spool to extend parallel to the second spool.

7. The net system recited in claim 1, wherein the hub includes a first face, an opposing second face, and a slot extending into the hub from the first face toward the second face such that the slot is open at the first face, the slot being sized to accommodate passage of the existing net.

8. The net system recited in claim 1, wherein the hub includes a pair grooves formed therein in opposed relation to each other, the pair of grooves being configured to receive respective ones of the first connector and the second connector.

9. The net system recited in claim 8, wherein the hub includes a pair of opposed end faces, the pair of grooves each extending from one of the pair of opposed end faces toward the other of the pair of opposed end faces.

10. The net system recited in claim 9, wherein each of the pair of grooves terminates in spaced relation to the pair of opposed end faces to define a shoulder.

11. The net system recited in claim 8, wherein the hub further includes a slot formed therein, the slot extending diametrically through the hub such that the pair of grooves are on opposite sides of the slot.

12. The net system recited in claim 1, wherein the hub includes a lower edge, the hub being configured to be placeable and supported by the existing net with the lower edge being positioned above an underlying ground surface.

13. An add-on net system configured for use with an existing net, the add-on net system comprising:

a hub configured to be placeable on the existing net to be supported by the existing net;

a first net module including a first net and a first connector connected to the first net, the first connector being detachably engageable with the hub; and a second net module including a second net and a second connecter connected to the second net, the second connector being detachably engageable with the hub.

14. The net system recited in claim 13, wherein the hub includes a first face, an opposing second face, and a slot extending into the hub from the first face toward the second face such that the slot is open at the first face, the slot being sized to accommodate passage of the existing net.

15. The net system recited in claim 13, wherein the hub includes a pair grooves formed therein in opposed relation to each other, the pair of grooves being configured to receive respective ones of the first connector and the second connector.

16. The net system recited in claim 15, wherein the hub includes a pair of opposed end faces, the pair of grooves each extending from one of the pair of opposed end faces toward the other of the pair of opposed end faces.

17. The net system recited in claim 16, wherein each of the pair of grooves terminates in spaced relation to the pair of opposed end faces to define a shoulder.

18. The net system recited in claim 15, wherein the hub further includes a slot formed therein, the slot extending diametrically through the hub such that the pair of grooves are on opposite sides of the slot.

* * * * *